US006879957B1

(12) United States Patent
Pechter et al.

(10) Patent No.: US 6,879,957 B1
(45) Date of Patent: Apr. 12, 2005

(54) METHOD FOR PRODUCING A SPEECH RENDITION OF TEXT FROM DIPHONE SOUNDS

(76) Inventors: William H. Pechter, 1295 Olde Doubloon Dr., Vero Beach, FL (US) 32963; Joseph E. Pechter, 1295 Olde Doubloon Dr., Vero Beach, FL (US) 32963

( * ) Notice: Subject to any disclaimer, the term of this patent is extended or adjusted under 35 U.S.C. 154(b) by 817 days.

(21) Appl. No.: 09/653,382

(22) Filed: Sep. 1, 2000

Related U.S. Application Data

(60) Provisional application No. 60/157,808, filed on Oct. 4, 1999.

(51) Int. Cl.[7] ..... G10L 13/08
(52) U.S. Cl. ..... 704/267; 704/260
(58) Field of Search ..... 704/267, 260

(56) References Cited

U.S. PATENT DOCUMENTS 5,384,893 A * 1/1995 Hutchins ..... 704/267
5,696,879 A * 12/1997 Cline et al. ..... 704/260
5,704,007 A * 12/1997 Cecys ..... 704/260
5,787,231 A * 7/1998 Johnson et al. ..... 704/260
5,930,754 A * 7/1999 Karaali et al. ..... 704/259
6,088,666 A * 7/2000 Chang et al. ..... 704/258
6,148,285 A * 11/2000 Busardo ..... 704/260
6,175,821 B1 * 1/2001 Page et al. ..... 704/258
6,266,637 B1 * 7/2001 Donovan et al. ..... 704/258

* cited by examiner

*Primary Examiner*—Richemond Dorvil
*Assistant Examiner*—Donald L. Storm
(74) *Attorney, Agent, or Firm*—Kevin P. Crosby; Daniel C. Crilly; Brinkley, McNerney et al.

(57) ABSTRACT

A text-to-speech system utilizes a method for producing a speech rendition of text based on dividing some or all words of a sentence into component diphones. A phonetic dictionary is aligned so that each letter within each word has a single corresponding phoneme. The aligned dictionary is analyzed to determine the most common phoneme representation of the letter in the context of a string of letters before and after it. The results for each letter are stored in phoneme rule matrix. A diphone database is created using a way editor to cut 2,000 distinct diphones out of specially selected words. A computer algorithm selects a phoneme for each letter. Then, two phonemes are used to create a diphone. Words are then read aloud by concatenating sounds from the diphone database. In one embodiment, diphones are used only when a word is not one of a list of pre-recorded words.

17 Claims, 1 Drawing Sheet

METHOD FOR PRODUCING A SPEECH RENDITION OF TEXT FROM DIPHONE SOUNDS

CROSS-REFERENCE TO A RELATED APPLICATION

This application claims priority from U.S. Provisional Application Ser. No. 60/157,808, filed Oct. 4, 1999, the disclosure of which is incorporated herein by reference.

BACKGROUND OF THE INVENTION

1. Field of the Invention

The present invention relates to speech synthesis systems and more particularly to algorithms and methods used to produce a viable speech rendition of text.

2. Description of the Prior Art

Phonology involves the study of speech sounds and the rule system for combining speech sounds into meaningful words. One must perceive and produce speech sounds and acquire the rules of the language used in one's environment. In American English a blend of two consonants such as "s" and "t" is permissible at the beginning of a word but blending the two consonants "k" and "b" is not; "ng" is not produced at the beginning of words; and "w" is not produced at the end of words (words may end in the letter "w" but not the sound "w"). Marketing experts demonstrate their knowledge of phonology when they coin words for new products; product names, if, chosen correctly using phonological rules, are recognizable to the public as rightful words. Slang also follows these rules. For example, the word "nerd" is recognizable as an acceptably formed noun.

Articulation usually refers to the actual movements of the speech organs that occur during the production of various speech sounds. Successful articulation requires (1) neurological integrity, (2) normal respiration, (3) normal action of the larynx (voice box or Adam's apple), (4) normal movement of the articulators, which include the tongue, teeth, hard palate, soft palate, lips, and mandible (lower jaw), and (5) adequate hearing.

Phonics involves interdependence between the three cuing systems: semantics, syntax, and grapho-phonics. In order to program words and use phonics as the tool for doing that, one has to be familiar with these relationships. Semantic cues (context: what makes sense) and syntactic cures (structure and grammar: what sounds right grammatically) are strategies the reader needs to be using already in order for phonics (letter-sound relationships: what looks right visually and sounds right phonetically) to make sense. Phonics proficiency by itself cannot elicit comprehension of text. While phonics is integral to the reading process, it is subordinate to semantics and syntax.

There are many types of letter combinations that need to be understood in order to fully understand how programming a phonics dictionary would work. In simple terms, the following letter-sound relationships need to be developed: beginning consonants, ending consonants, consonant digraphs ("sh," "th," "ch," "wh"), medial consonants, consonant blends, long vowels and short vowels.

Speech and language pathologists generally call a speech sound a "phoneme". Technically, it is the smallest sound segment in a word that we can hear and that, when changed, modifies the meaning of a word. For example the word "bit" and "bid" have different meanings yet they differ in their respective sounds by only the last sound in each word (i.e., "t" and "d"). These two sounds would be considered phonemes because they are capable of changing meaning. Speech sounds or phonemes are classified as vowels and consonants. The number of letters in a word and the number of sounds in a word do not always have a one-to-one correspondence. For example, in the word "squirrel", there are eight letters, but there are only five sounds: "s"-"k"-"w"-"r"-"l."

A "diphthong" is the sound that results when the articulators move from one vowel to another within the same syllable. Each one of these vowels and diphthongs is called a speech sound or phoneme. The vowel sounds are a, e, i, o, u, and sometimes y, but when we are breaking up words into sounds they may be five or six vowel letters, but approximately 17 distinct vowel sounds. One should note that there are some variations in vowel usage due to regional or dialectical differences.

Speech-language pathologists often describe consonants by their place of articulation and manner of articulation as well as the presence or absence of voicing. Many consonant sounds are produced alike, except for the voicing factor. For instance, "p" and "b" are both bilabial stops. That is, the sounds are made with both lips and the flow of air in the vocal tract is completely stopped and then released at the place of articulation. It is important to note, however, that one type of consonant sound is produced with voicing (the vocal folds are vibrating) and the other type of consonant sound is produced without voicing (the vocal folds are not vibrating).

The concepts described above must be taken into account in order to enable a computer to generate speech which is understandable to humans. While computer generated speech is known to the art, it often lacks the accuracy needed to render speech that is reliably understandable or consists of cumbersome implementations of the rules of English (or any language's) pronunciation. Other implementations require human annotation of the input test message to facilitate accurate pronunciation. The present invention has neither of these limitations.

SUMMARY OF THE INVENTION

It is a principle object of this invention to provide a text to speech program with a very high level of versatility, user friendliness and understandability.

In accordance with the present invention, there is a method for producing viable speech rendition of text comprising the steps of parsing a sentence into a plurality of words and punctuation, comparing each word to a list of pre-recorded words, dividing a word not found on the list of pre-recorded words into a plurality of diphones and combining sound files corresponding to the plurality of diphones, and playing a sound file corresponding to the word.

The method may also include the step of adding inflection to the word in accordance with the punctuation of the sentence.

The method may further include using a database of diphones to divide the word into a plurality of diphones.

These and other objects and features of the invention will be more readily understood from a consideration of the following detailed description, taken with the accompanying drawings.

In Phase 1 of our project, we developed: a parser program in Qbasic; a file of over 10,000 individually recorded common words; and a macro program to link a scanning and optical character recognition program to these and a wav player so as to either say or spell each word in text. We tested many different articles by placing them into the scanner and running the program. We found that of the 20 articles we placed into the scanner, 86% of the words were recognized by our program from the 10,000 word list. Our major focus for Phase 2 of our project has been on the goal of increasing accuracy. Our 86% accuracy with phase one was reasonable, but this still meant that, on average, one to two words per line had to be spelled out, which could interrupt the flow of the reading and make understanding the full meaning of a sentence more difficult. We have found some dictionaries of words of the English language with up to 250,000 words. To record all of them would take over 1,000 hours and still would not cover names, places, nonsense words or expressions like "sheesh", slang like "jumpin", or new words that are constantly creeping into our language. If we recorded a more feasible 20,000 new words, ti would probably only have increased the accuracy by 1 to 2%. A new approach was needed. We felt the most likely approach to make a more dramatic increase would involve phonetics. Any American English word can be reasonably reproduced as some combination of 39 phonetic sounds (phonemes). We researched phonetics and experimented linking together different phonemes, trying to create understandable words with them. Unfortunately, the sounds did not sound close enough to the appropriate word, rendering the process infeasible. Most spoken words have a slurring transition from one phoneme to the next. When this transition is missing, the sounds are disjointed and the word is not easily recognized. Overlapping phoneme wav files by 20% helped, but not enough. Other possibilities then considered were the use of syllables or groupings of 2 or 3 phonemes (diphones and triphones). Concatenations of all of these produced a reasonable approximation of the desired word. The decision to use diphones was based on practicality. Only diphones are needed as opposed to 100,000 triphones. Due to the numbers, we elected to proceed with using diphones. The number could be further reduced by avoiding combinations that never occur in real words. We elected to include all combinations because names, places and nonsense words can have strange combinations of sounds and would otherwise need to be spelled out. By experimentation, we found that simply saying the sound did not work well. This produced too many accentuated sounds that did not blend well. What worked best was cutting the diphone from the middle of a word, using a good ear and a wav editor to cut the sound out of the word. We initially tried to cut the diphones from 12 or more letter words, since long words would potentially have more diphones in them, but there was so much duplication that we shortly switched to a more methodical method of searching a phonetic dictionary for words with a specific diphone, cutting out that single diphone, and then going on to the next one on the list. If no word could be found, we would create a nonsense word with the desired diphone in the middle of the word, and then extract it with the editor. A considerable amount of time was spent perfecting the process of extracting the diphones. We needed to get the tempo, pitch, and loudness of each recording as similar as possible to the others in order to allow good blending.

We decided to use a hybrid approach in our project. Our program uses both whole words (from out list of 10,000 words) and also concatenated words (from the linking of diphones). Any word found on our main list would produce the wav recording of that entire word. All other words would be produced by concatenation of diphones unless it included a combination of letters and numbers (like B42) in which case it would be spelled out.

We next needed an algorithm to determine which phonemes and diphones to give for a given word. We first explored English texts and chapters dealing with pronunciation rules. Though many rules were found, they were not all inclusive and had many exceptions. We next searched the Internet for pronunciation rules and found an article by the Naval Research Laboratory "Document AD/A021 929 published by National Technical Information Services". It would have required hundreds of nested if-then statements and reportedly it still had only mediocre performance. We decided to try to create our own set of pronunciation rules by working backwards from a phonetic dictionary. We were able to find such a dictionary (CMU dictionary (v0.6)) at the website identified by the uniform resource locator (URL) "ftp://ftp.cs.cmu.edu/project/speech/dict." It had over 100,000 words followed by their phonetic representation. The site made it clear this was being made freely available for anyone's use.

Out strategy was to have every letter of each word represented by a single phoneme, and then to find the most common phoneme representation of a letter when one knew certain letters that preceded and followed it. Not all words have the same number of letters as phonemes, so we first had to go through the list and insert blank phonemes when there were too many letters for the original number of phonemes (like for ph, th, gh or double consonant . . . the first letter carried the phoneme of the sound made and the second letter would be the blank phoneme). In other cases we combined two phonemes into one in the less common situation when there were too many phonemes for the number of letters in the word. These manipulations left us with a dictionary of words and matching phonemes; each letter of each word now had a matching phoneme. We used this aligned dictionary as input for a Visual Basic program which determined which was the most common phoneme representation for a given letter, taking into account the one letter before and two letters after it. This was stored in 26×26×26×26 matrix form and output to a file so it could be input and used in the next program. Our next program tested the effectiveness of this matrix in predicting the pronunciation of each word on the original phoneme dictionary list. This program utilized the letter to phoneme rules of the matrix for each word and then directly compared this with the original phoneme assigned to that letter by the dictionary. It found 52% of the words were given the entirely correct pronunciation, 65% were either totally correct or had just one letter pronounced incorrectly, and over all 90% of all letters were assigned the correct pronunciation.

In an attempt to obtain better accuracy we attempted to look at the 3 letters before and 3 letters after the given letter, but in order to put the results in a simple standard matrix by the same technique, we would have needed a 26×26×26×26×26×26×26 matrix, which required more space than out computer allowed. Instead, we created different types of matrices within separate file names for each letter of the alphabet. In our "a" file we included a list of 7 letters strings with the 3 letters before and 3 letters after every "a" found in our phonetic dictionary. We made additional files for b thru z. Again we found the most common phoneme representation of "a" for each distinct 7 letter string that had "a" as the middle letter. By reading these into 26 different 1 dimensional matrix files, the additional run-search time of the program was minimized. We kept the 1 before-2 after matrix as a backup to be used if letters in the input word did not have a 7 letter match to any word in the phonetic dictionary. Using this technique, accuracy improved dramatically. 98% of all letters (804961/823343) were assigned to the correct pronunciation. 86% of words (96035/111571) were entirely correct and 98% (109196/111571) had, at most, one letter pronounced incorrectly. When only one letter was incorrect, the word was actually still understandable.

We next turned our attention to solving other problems that can plague a text to speech program. Homographs are words that have the same spelling but different pronunciation depending on context. For the word "wind" it is necessary to know whether it should be pronounced like "blowing in the wind" or like "to wind the clock". The most common type homographs have one word as a noun and the other as a verb. We decided to use part of speech context to determine which was more likely in a given sentence. Searching the Internet, we found a public domain dictionary of 230,000 words with their parts of speech. The dictionary is entitled the "Moby Part-of-Speech Dictionary" and is located at the website identified by the URL "ftp://ftp.dcs.shef.ac.uk/share/ilash/Moby/impos.tar.Z." We used this to create a decision matrix that looks at the part of speech of two words before and two after the given word to give the most likely part of speech for the given word. We primed this decision matrix by analyzing sentences from several novels. This result yielded almost a 70% likelihood of getting the right pronunciation.

We also included a prosodromic variation into our project. This is an attempt to avoid an overly flat, monotone, machine-like pronunciation. We adjusted the tempo and pitch of the last word of each sentence to give a more reading tone to the program.

The program still allows the blind or visually impaired individual to run the entire program and read any typed material by just pressing one button. Our macro interface program does the rest. In addition, we have added a feature that allows this program to be used to verbalize any email or text file.

The accuracy of our current program has increased to 96%, with most errors being due to optical character recognition mistakes. It can still be fit onto a single CD. Its high accuracy rate, better clarity due to its hybrid nature, and simplicity of use from scan to speech make it better than anything at all similar we have seen to date.

The process(es) of the invention is carried out as follows:

1) Test aligned phoneme dictionary to make sure it is aligned and to make adjustments.
2) Compare each word in aligned phoneme dictionary to the list of phonemes, delete rarities.
3) Convert the 46 phonemes to numbers.
4) Look in aligned dictionary for the letter "a" and print out 1 letter before, 2 letters after and the corresponding phonemes. Repeat for all other letters.
5) Create entire 1 before, 2 after matrix using the most common phoneme for each combination.
6) Convert any word phonemes using the 1 before, 2 after matrix.
7) Test accuracy of matrix by comparing the original phoneme representation of each word in the aligned dictionary with its phoneme representation as created by following matrix rules.
8) Find words that contain a given diphone so we can use that word to create the diphone database.
9) Create a pipe for each letter in aligned dictionary using 3 letters before, 3 letters after, use numbers to represent and create a separate file for each letter (26 files).
10) Create entire pipe of 3 before and 3 after using the most common phoneme for each combination.
11) Find most common phoneme for each letter in the aligned dictionary.
12) Add the most common phoneme for each letter to the 1 before 2, after matrix to fill up all blank slots.
13) Read text file using the 1 before, 2 after matrix and the diphone database.
14) Read text file using the 3 before, 2 after pipe and the diphone database.
15) Input the 3 by 3 pipe containing the most common phoneme for each slot at this start of the program and print the phoneme representation of a single word.
16) Compare the original phoneme representation of each word in the aligned dictionary with its phoneme representation as created by 3 by 3 pipe rules; check accuracy for phonemes and for complete words.
17) Convert a text file to sentences, parse it, find the part of speech of each word in the sentence, and output the data to a file to use with the homograph matrix.
18) Macro programmed at the click of one button for scanner to scan a document, run OCR, turn it into text, direct the text to be saved in a file, and run our Visual Basic program.
19) Macro programmed to select the text or email currently on the screen, to direct the text be saved in a file, and run our Visual Basic program.
20) Visual Basic file programmed to open the text file saved by the Macro and input it line by line until the file is exhausted. The words and punctuation are parsed, checked with our 10,000 word dictionary of fully recorded words, checked for homographs and distinguished using our homograph matrix, checked for numbers. If none of the above apply the phoneme representation of a word is found using the 3 by 3 matrix and if not found there, then the 1 before, 2 after matrix is used. The word is then compiled from our diphone database. Prosodromic variation is used at the end of a sentence.

DESCRIPTION OF A PREFERRED EMBODIMENT

Figure 1:
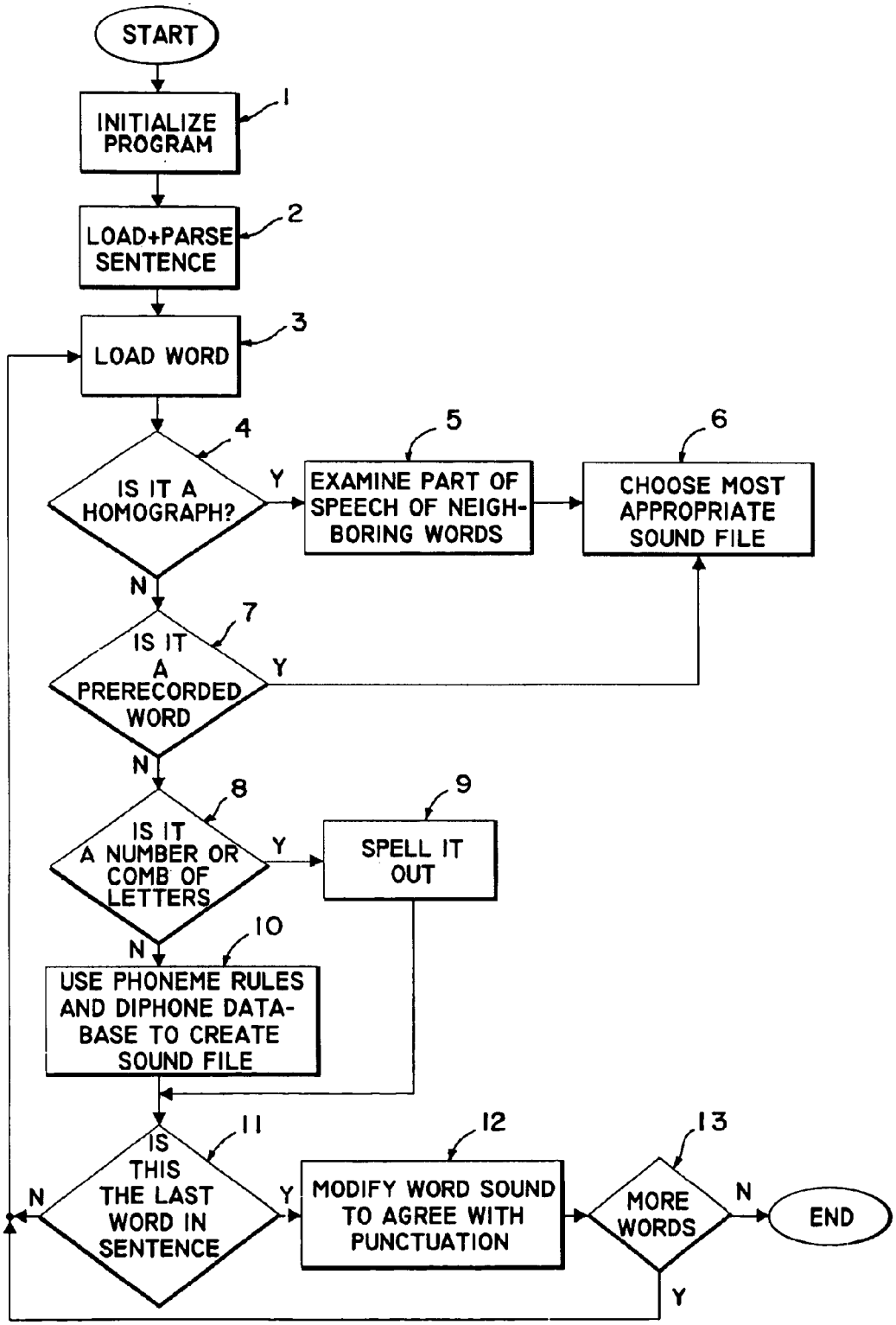
FIG. 1 is a flow diagram of the speech rendition algorithm of the present invention.

Viable speech rendition of text obviously requires some text signal to be available as input to the algorithm. There are a variety of mechanisms known in the art to provide text to a software program. These methods include scanning a paper document and converting it into a computer text file, capturing a text message on a computer screen and saving it to a text file, or using an existing computer text file. Any of these or similar methods could be employed to provide input to the algorithm.

Referring now to drawing, FIG. 1 is a flow diagram of the algorithm used to produce a viable speech rendition of text. The flow diagram should be read in conjunction with the source code, which is set forth below. The basic program begins with an initialization routine. This initialization routine involves loading a file which contains the phoneme decision matrices and loading a wav (i.e. sound) file containing a list of pre-recorded words. The matrices are used in the operation of the program to decide the appropriate sound for a given letter. Certain other variables suited for use in the program execution which will be apparent to one of skill in the art may also be initialized.

Following initialization, the program loads (step 2) the first sentence from the text file. The sentence is parsed (step 2), or broken up, into the sequence of words which form the sentence. Each word is examined in turn (step 3) according to the criteria in steps 4, 7, and 8. The program uses both whole words (from an exemplary list of, for example, 10,000 words) and also concatenated words (from the linking of diphones). Any word found on the main list is produced using the sound recording of that entire word. All other words are produced by the concatenation of diphones unless it included a combination of letters and numbers (like "B42") in which case it is spelled out.

The word is first checked against a list of homographs (step 4). If the word is a homograph, the parts of speech of the adjacent words are determined (step 5). Based on a decision tree, the most appropriate sound file is used (step 6). Alternatively, the word is checked against a list of pre-recorded words (step 7). If the word is contained in the list, the appropriate sound file is used (step 6). If the word is not on either list, the word is checked to see if it contains a combination of numbers and letters (step 8). If so, it is spelled out (step 9). Otherwise, the phoneme rules and a diphone database are used to create the sound file for the word (step 10). The phoneme rules create an algorithm to determine which phonemes and diphones to use for a given word based on pronunciation rules. A set of pronunciation rules was created by working backwards from the CMU phonetic dictionary found on the Internet containing over 100,000 words followed by their phonetic representation. The letter to phoneme rules database was created from the phonetic representations of the words from this phonetic dictionary. The representations are used as data for the letter to phoneme rules which use the phoneme decision matrices. The diphone database consists of combinations of two of the 46 phonemes, making a total of 46×46 files. The pronunciation rules are incorporated in the diphone concatenation. Prosodrome variation and homograph discrimination are also used to correctly pronounce words and sentences. Our strategy was to have every letter of each word represented by a single phoneme, and then to find the most common phoneme representation of a letter when one knew certain letters that preceded and followed it. Not all words have the same number of letters as phonemes, so we first had to go through the list and insert blank phonemes when there were too many letters for the original number of phonemes (e.g. for "ph", "th", "gh" or double consonants, the first letter carries the phoneme of the sound made and the second letter would be the blank phoneme). In other cases we combined two phonemes into one in the less common situation when there were too many phonemones for the number of letters in the word.

In an attempt to obtain better accuracy one could look at some other combination of letters, such as the 3 letters before and 3 letters after the given letter. In order to put the results in a simple standard matrix by the same technique, a 26×26×26×26×26×26×26 matrix is used.

Alternatively, different types of matrices can be created within separate file names for each letter of the alphabet. In our "a" file we included a list of 7 letter strings with the 3 letters before and 3 letters after every "a" found in the phonetic dictionary. We made additional files for b thru z. Again we found the most common phoneme representation of "a" for each distinct 7 letter string that had "a" as the middle letter. By reading these into 26 different dimensional matrix files, the additional run-search time of the program was minimized. We kept the 1 before-2after matrix as a backup to be used if letters in the input word did not have a 7 letter match to any word in the phonetic dictionary. Using this technique, accuracy improved dramatically. 98% of all letters were assigned to the correct pronunciation. 86% of words were entirely correct and 98% had, at most, one letter pronounced incorrectly. When only one letter was incorrect, the word was usually still understandable.

If the word is the last one in the sentence (step 11), a modified version of the word is used to provide the inflection in accordance with the punctuation (step 12). The process is continued until the entire text file is read (step 13).

In practice, the invention is utilized by scanning the printed material to be converted to speech and starting the macro program. The macro program guides the computer to scan the text, perform optical character recognition, saved the result as a text file, and start the basic program. The basic program is carried out by loading the phoneme decision matrices that will be used to decide the appropriate sound for a given letter. The program also loads the list of full words that have previously been recorded. The program then inputs a line from the text file and a parcer breaks it up into words. The program keeps doing this until it reaches an end of sentence punctuation or the end of the text file. Next, the program examines words one at a time. If the examined word is on the homograph list, the program checks the part of speech of two words before and two words after the examined word and uses the decision tree to decide the most appropriate sound file to use. If the examined word is on the list of pre-recorded entire words, the appropriate wav file is used. If the examined word is a number or a combination of letters and numbers, it is spelled out. Otherwise, the phoneme rules and the diphone database are used to create the word wav file. If the examined word is the last word of a sentence, a modified version of the word is used to replicate natural/normal speech. The program continues to examine new sentences until the text file is exhausted. When email or computer text files are encountered, the file is saved and the process begins with the loading of the phoneme decision matrices as referenced above.

The source code for the program follows:

```
Visual Basic Code for Project1 (Project1.vbp): Hybrid Text to Speech
2000
Form1.frm
Label: "Reading . . . Press ESCAPE to Exit"
CODE:
Private Sub Form_KeyDown(KeyCode As Integer, Shift As Integer)
If KeyCode = 27 Then End
End Sub
Private Sub Form_Load( )
Form1.Visible = False
Clipboard.Clear
SendKeys "%", True
SendKeys "e", True
SendKeys "l", True
SendKeys "%", True
SendKeys "e", True
SendKeys "c", True
clipp = Clipboard.GetText
If RTrim(LTrim(clipp)) = " " Then
SendKeys "%EA", True
SendKeys "%EC", True
End If
clipp = Clipboard.GetText
If RTrim$(LTrim$(clipp)) = " " Then GoTo 500
Open "c:\hybrid2000\final\out.txt" For Output As #2
Open "c:\hybrid2000\final\input.txt" For Input As #1
Open "c:\hybrid2000\final\words.txt" For Input As #3
Open "c:\hybrid2000\final\homopipe.txt" For Input As #8
Open "c:\hybrid2000\final\homolist.txt" For Input As #6
```

-continued

```
Open "c:\hybrid2000\final\mata.txt" For Input As #4
Open "c:\hybrid2000\increase accuracy\list\list.txt" For Input As #5
Dim all (26)
all(1) = 3
all(2) = 7
all(3) = 20
all(4) = 9
all(5) = 46
all(6) = 14
all(7) = 15
all(8) = 46
all(9) = 17
all(10) = 19
all(11) = 20
all(12) = 21
all(13) = 22
all(14) = 23
all(15) = 25
all(16) = 27
all(17) = 20
all(18) = 28
all(19) = 29
all(20) = 31
all(21) = 46
all(22) = 35
all(23) = 36
all(24) = 41
all(25) = 18
all(26) = 38
'convert text file to sentences
Dim sep(1000)
Dim pun(1000)
Dim wor(100)
Dim homog(5)
Dim homogg(5)
Dim diphone(100)
k = 0
b = " "
10  a = clipp
    b = b + LTrim$(RTrim$(a))
    If LTrim$(RTrim$(b)) = " " Then GoTo 25
    b = LTrim$(RTrim$(LCase$(b))) + " "
    'dash
    If Mid$(b, Len(b) - 1, 1) = "-" Then
        b = Mid$(b, 1, Len(b) - 2)
        GoTo 25
    End If
    'end dash check
15  l = Len(b)
    If l = 0 Then GoTo 25
    For i = 1 To l
      If Mid$(b, i, 1) = " " Then GoTo 20
      If Asc(Mid$(b, i, 1)) >= 48 And Asc(Mid$(b, i, 1)) <= 57
      Then GoTo
20
      'if a character isn't a letter, space, or number then:
      If Asc(Mid$(b, i, 1)) - 96 < 1 Or Asc(Mid$(b, i, 1)) - 96 > 26
      Then
        'start appostrophe check
            If Mid$(b, i, 1) = "'" Then
              If i = 1 Then
                b = Mid$(b, 2, l - 1)
                GoTo 15
              End If
              If Asc(LCase(Mid$(b, i - l, 1))) > 97 And
Asc(LCase(Mid$(b, i - 1, 1))) < 123 And Asc(LCase(Mid$(b, i + 1,
1))) > 97 And
Asc(LCase(Mid$(b, i + 1, 1))) < 123 Then
                If Mid$(b, i, 2) = "'s" Then
                    b = Mid$(b, 1, i - 1) + Mid$(b, i + 1, l - i)
                    GoTo 15
              End If
              GoTo 20
            Else
              b = Mid$(b, 1, i - 1) + Mid$(b, i + 1, 1 - i)
              GoTo 15
            End If
          End If
          'end appostrophe check
```

-continued

```
          '@ check
          If Mid$(b, i, 1) = "@" Then
            If i = 1 Then
              b = "at " + Mid$(b, 2, Len(b) - 1)
              GoTo 15
            End If
            b = Mid$(b, 1, i - 1) + " at " + Mid$(b, i + 1, l - i)
            GoTo 15
          End If
          'end @ check
          'if it's a "," "." "!" "?" then:
          If Mid$(b, i, 1) = "," Or Mid$(b, i, l) = "."
Or Mid$(b, i, 1) = "!" Or Mid$(b, i, 1) = "?" Then
            If i = 1 Then
              b = Mid$(b, 2, Len(b) - 1)
              GoTo 15
            End If
            k = k + 1
            sep(k) = LTrim$(RTrim$(Mid$(b, 1, i - 1))) + " "
            pun(k) = Mid$(b, i, 1)
            b = LTrim$(RTrim$(Mid$(b, i + 1, Len(b) - i))) + " "
            GoTo 15
          End If
          'change every different character to a space
          If i = 1 Then
            b = Mid$(b, 2, l - 1)
            GoTo 15
          End If
          b = RTrim$(LTrim$(Mid$(b, 1, i - 1) + " " +
Mid$(b, i + 1, l - i))) + " "
          GoTo 15
          'end change to space
        End If
20      Next i
25
k = k + 1
If sep(k - 1) = b Then
    k = k - 1
Else
    sep(k) = RTrim$(LTrim$(b)) + " "
    pun(k) = ","
End If
'end convert text file into sentences
pauser = 0
For i = 1 To k
    If pun(i) = "." Or pun(i) = "!" Or pun(i) = "?"
Then pauser = pauser + 1
        If pauser = 5 Then
        Close #2
        Open "c:\hybrid2000\final\out.txt" For Input As #2
        Me.Show
        Me.KeyPreview = True
        Do
        Line Input #2, www
        x% = sndPlaySound(www, SND_SYNC)
        DoEvents
        Loop Until EOF(2)
        Close #2
        Open "c:\hybrid2000\final\out.txt" For Output As #2
        pauser = 0
    End If
    If RTrim$(LTrim$(sep(i))) = " " Then GoTo 41
    c = 1
    For ii = 1 To 5
    homog(ii) = "10"
    homogg(ii) = " "
    Next ii
    For j = 1 To Len(sep(i))
        If Mid$(sep(i), j, 1) = " " Then
            a = LTrim$(RTrim$(Mid$(sep(i), c, j - c)))
            c = j + 1
            If a = " " Then GoTo 40
            'now that we have a . . .
            If LCase$(a) = "headers" Then GoTo 500
            'check for number in word, if yes, spell
            For i2 = 1 To Len(a)
                If Asc(Mid$(a, i2, 1)) >= 48 And
Asc(Mid$(a, i2, 1)) <= 57 Then
                    For i3 = 1 To Len(a)
```

-continued

```
                    Print #2, "c:\hybrid2000\master\" +
Mid$(a, i3, 1) + ".wav"
                Next i3
                If j = Len(sep(i)) Then Print #2,
"c:\hybrid2000\master\,.wav"
                homog(1) = homog(2)
                homog(2) = "zzzz"
                GoTo 40
            End If
        Next i2
        'end number check
        'homograph check
        Close #6
        Open "c:\hybrid2000\final\homolist.txt" For Input As #6
        Do
        Line Input #6, homot
        homot = LCase$(homot)
        If Mid$(homot, 1, Len(homot) - 2) = a Then
            homog(3) = a
            If c >= Len(sep(i)) Then GoTo 26
            If LTrim$(RTrim$(Mid$(sep(i), c, Len(sep(i)) -
            c))) = " "
Then GoTo 26
            homod = Mid$(sep(i), c, Len(sep(i)) - c)
            hii = 1
            hoo = 0
            For hoi = 1 To Len(homod)
                If Mid$(homod, hoi, 1) = " " Then
                    hoo = hoo + 1
                    If hoo = 3 Then GoTo 26
                    homog(hoo + 3) = Mid$(homod, hii,
                    hoi - 1)
                    hii = hoi + 1
                End If
            Next hoi
            Open "c:\hybrid2000\final\pos7.txt" For Input As #7
            Do
            Line Input #7, homop
            For jh = 1 To 5
                If homog(jh) = Mid$(homop, 1, Len(homop) - 2)
                Then
                    homogg(jh) = Mid$(homop, Len(homop), 1)
                End If
            Next jh
            Loop Until EOF(7)
            Close #7
            For jh = 1 To 5
                If homog(jh) = 10 Then homogg(jh) = "10"
                If homogg(jh) = " " Then homogg(jh) = "11"
            Next jh
            homo1 = homogg(1) + " " + homogg(2) + " " + "1" +
" " + homogg(4) + " " + homogg(5)
            homo2 = homogg(1) + " " + homogg(2) + " " + "2" +
" " + homogg(4) + " " + homogg(5)
            Close #8
            Open "c:\hybrid2000\final\homopipe.txt" For Input
            As #8
            Do
            Line Input #8, homopi
            If homo1 = homopi Then
                Print #2,
                "c:\hybrid2000\homographs\" + a + "-n.wav"
                GoTo 40
            End If
            If homo2 = homopi Then
                Print #2,
                "c:\hybrid2000\homographs\" + a + "-v.wav"
                GoTo 40
            End If
            Loop Until EOF(8)
            If Val(Mid$(homot, Len(homot), 1)) = 1
            Then Print #2,
"c:\hybrid2000\homographs\" + a + "-n.wav"
            If Val(Mid$(homot, Len(homot), 1)) = 2
            Then Print #2,
"c:\hybrid2000\homographs\" + a + "-v.wav"
            GoTo 40
        End If
        Loop Until EOF(6)
```

-continued

```
        'end homograph check
        homog(1) = homog(2)
        homog(2) = a
        'Check in 10000 wordlist
        Close #3
        Open "c:\hybrid2000\final\words.txt" For Input As #3
        Do
        Line Input #3, aa
        If a = aa Then
            If j = Len(sep(i)) Then
                If pun(i) = "," Then
                    Print #2, "c:\hybrid2000\master\" +
                    a + ".wav"
                    Print #2, "c:\hybrid2000\master\,.wav"
                    GoTo 40
                End If
                If pun(i) = "." Then
                    If a > "funds" Then
                    Print #2,
                    "c:\hybrid2000\master3\" + a +
                    ".wav"
                    Print #2,
                    "c:\hybrid2000\master2\,.wav"
                    Else
                    Print #2, "c:\hybrid2000\master2\" +
                    a + ".wav"
                    Print #2,
                    "c:\hybrid2000\master2\,.wav"
                    End If
                    GoTo 40
                End If
                If pun(i) = "!" Then
                    If a > "funds" Then
                    Print #2, "c:\hybrid2000\master3\" +
                    a + ".wav"
                    Print #2,
                    "c:\hybrid2000\master2\,.wav"
                    Else
                    Print #2, "c:\hybrid2000\master2\" +
                    a + ".wav"
                    Print #2,
                    "c:\hybrid2000\master2\,.wav"
                    End If
                    GoTo 40
                End If
                If pun(i) = "?" Then
                    Print #2, "c:\hybrid2000\question\" +
                    a + ".wav"
                    Print #2,
                    "c:\hybrid2000\question\,.wav"
                    GoTo 40
                End If
            End If
            Print #2, "c:\hybrid2000\master\" + a +
            ".wav"
            GoTo 40
        End If
        Loop Until EOF(3)
        'end 10000 check
        'Check in added wordlist
        Close #5
        Open "c:\hybrid2000\increase accuracy\list\list.txt"
For Input As #5
        Do
        Line Input #5, aa
        If a = aa Then
            Print #2, "c:\hybrid2000\increase accuracy\list\" +
a + ".wav"
            If j = Len(sep(i)) Then
                If pun(i) = "," Then
                    Print #2, "c:\hybrid2000\master\,.wav"
                End If
                If pun(i) = "." Then
                    Print #2, "c:\hybrid2000\master2\,.wav"
                End If
                If pun(i) = "!" Then
                    Print #2, "c:\hybrid2000\master2\,.wav"
                End If
                If pun(i) = "?" Then
```

-continued

```
                    Print #2,
                    "c:\hybrid2000\question\,.wav"
                End If
            End If
            GoTo 40
        End If
        Loop until EOF(5)
        'end added words check
        'appostrophe check
        For i2 = 1 To Len(a)
            If Mid$(a, i2, 1) = "'" Then
                a = Mid$(a, 1, i2 - 1) + Mid$(a, i2 + i,
                Len(a) - i2)
            End If
        Next i2
        'end app check
        'Convert letters to phonemes, play diphones
        LL = Len(a)
        aa = "   " + a + "   "
        For m = 4 To LL + 4
            wor(m - 3) = Mid$(aa, m - 3, 7)
        Next m
        For m = 1 To LL
            hh = Mid$(wor(m), 4, 1)
            Open "c:\hybrid2000\final\" + hh + "2.txt"
For Input As #9
            Do
            Line Input #9, y
            If Mid$(y, 1, 7) = wor(m) Then
                wor(m) = Mid$(RTrim$(y), 10, Len(y) - 9)
                Close #9
                GoTo 30
            End If
            Loop Until EOF(9)
            Close #9
            wor(m) = Mid$(wor(m), 3, 4)
        Next m
        For m = 1 To LL
            If Len(wor(m)) = 4 Then
                u = Mid$(wor(m), 2, 1)
                v = Mid$(wor(m), 1, 1)
                w = Mid$(wor(m), 3, 1)
                xx2 = Mid$(wor(m), 4, 1)
                matwor = v + u + w + xx2
                'matrix check
                Close #4
                Open "c:\hybrid2000\final\mat" + u + ".txt"
For Input As #4
                Do
                Line Input #4, matche
                If Mid$(matche, 1, 4) = matwor Then
                    wor(m) = Val(Mid$(matche, 6,
                    Len(matche) - 5))
                    GoTo 31
                End If
                Loop Until EOF(4)
                wor(m) = all(Asc(u) - 96)
                'end matrix check
31          End If
        Next m
        njw = " "
        kjw = 0
        For m = 1 To LL
        If Val(wor(m)) = 46 Then GoTo 35
        If njw = " " Then
        njw = Str$(Val(wor(m)))
        GoTo 35
    End If
    kjw = kjw + 1
    diphone(kjw) = LTrim$(njw) + "-" +
    LTrim$(Str$(Val(wor(m))))
+ ".wav"
    njw = " "
    Next m
    If njw = " " Then GoTo 36
    kjw = kjw + 1
    diphone(kjw) = LTrim$(njw) + ".wav"
36
    If j = Len(sep(i)) Then
```

-continued

```
        If pun(i) = "," Then
            For m = 1 To kjw
                Print #2,
                "c:\hybrid2000\diphones\" +
diphone(m)
            Next m
            Print #2, "c:\hybrid2000\master\,.wav"
            GoTo 40
        End If
        If pun(i) = "." Then
            For m = 1 To kjw
                Print #2,
                "c:\hybrid2000\diphones\" +
diphone(m)
            Next m
            Print #2, "c:\hybrid2000\master\,.wav"
            GoTo 40
        End If
        If pun(i) = "!" Then
            For m = 1 To kjw
                Print #2,
                "c:\hybrid2000\diphones\" +
diphone(m)
            Next m
                Print #2,
                "c:\hybrid2000\master\,.wav"
                GoTo 40
        End If
        If pun(i) = "?" Then
            For m = l To kjw
                Print #2,
                "c:\hybrid2000\diphones\" +
diphone(m)
            Next m
            Print #2,
            "c:\hybrid2000\master\,.wav"
            GoTo 40
        End If
    For m = 1 To kjw
        Print #2,
        "c:\hybrid2000\diphones\" + diphone(m)
    Next m
    GoTo 40
  End If
  For m = 1 To kjw
      Print #2, "c:\hybrid2000\diphones\" + diphone(m)
  Next m
'end convert and play
End If
40 Next j
41 Next i
Close #2
Open "c:\hybrid2000\final\out.txt" For Input As #2
Me.Show
Me.KeyPreview = True
Do
Line Input #2, www
x% = sndPlaySound(www, SND_SYNC)
DoEvents
Loop Until EOF(2)
500
End
End Sub
MODULE1 (Module1.bas)
Declare Sub Sleep Lib "kernel32" (ByVal dwMilliseconds As Long)
Declare Function sndPlaySound Lib "WINMM.DLL" Alias
"sndPlaySoundA"
(ByVal lpszSoundName As String, ByVal uFlags As Long) As Long
Public Const SND_SYNC = &H0
Visual Basic Code for Project1 (Project1.vbp): Hybrid Increase
Accuracy
Form1 (Form1.frm)
Contains Textbox
CODE:
Private Sub Form_Load( )
    Form1.Visible = True
    x% = sndPlaySound("c:\hybrid2000\increase accuracy\do.wav",
SND_SYNC)
End Sub
```

-continued

```
Private Sub Text1_KeyPress(KeyAscii As Integer)
If KeyAscii = 13 Then
    KeyAscii = 0
    Form1.Visible = False
    a = Shell ("c:\windows\sndrec32.exe", vbNormalFocus)
    x% = sndPlaySound("c:\hybrid2000\increase
accuracy\twosecs.wav", SND_SYNC)
    SendKeys " ", True
    Sleep (2000)
    SendKeys " ", True
    SendKeys "{TAB}", True
    SendKeys "{TAB}", True
    SendKeys "{TAB}", True
    SendKeys " ", True
    Sleep (2200)
    SendKeys "%", True
    SendKeys "{DOWN}", True
    SendKeys "a", True
    Sleep (1000)
    bee = "c:\hybrid2000\increase accuracy\list\" +
RTrim$(LTrim$(LCase$(Text1.Text))) + "~"
    SendKeys bee, True
    Sleep (1000)
    SendKeys "~", True
    Sleep (500)
    SendKeys "~", True
    Sleep (200)
    SendKeys "%", True
    SendKeys "{DOWN}", True
    SendKeys "x", True
    'update wordlist
    Dim wo(100)
    i = 0
    Open "c:\hybrid2000\increase accuracy\list\list.txt" For
Input As #1
    Do
    Line Input #1, w
    i = i + 1
    wo(i) = w
    Loop Until EOF(1)
    Close #1
    Open "c:\hybrid2000\increase accuracy\list\list.txt" For
Output As #2
    For j = 1 To i
    Print #2, wo(j)
    Next j
    Print #2, RTrim$(LTrim$(LCase$(Text1.Text)))
    End
End If
End Sub
MODULE1 (MODULE1.bas)
Declare Function sndPlaySound Lib "WINMM.DLL" Alias
"sndPlaySoundA" (ByVal lpszSoundName As String, ByVal uFlags As
Long) As Long
Public Const SND_SYNC = &H0
Declare Sub Sleep Lib "kernel32" (ByVal dwMilliseconds As Long)
```

The present invention has been described with reference to a single preferred embodiment. Obvious modifications of this process, including the elimination of the list of prerecorded words in favor of using the diphone database, are intended to be within the scope of the invention and of the claims which follow.

We claim:

1. A method for producing a speech rendition of text comprising:

parsing a sentence into punctuation and a plurality of words;

comparing at least one word of the plurality of words to a list of pre-recorded words;

in the event that the compared word is not on the list of pre-recorded words, determining whether the compared word includes at least one number, and audibly spelling the compared word out in the event that the compared word includes at least one number, in the event that the compared word is not on the list of pre-recorded words and does not include at least one number, dividing the compared word into a plurality of diphones, combining sound files corresponding to the plurality of diphones, and playing the combined sound files;

in the event that the compared word is on the list of pre-recorded words, playing a sound file corresponding to the compared word, the sound file being independent of the sound files corresponding to the plurality of diphones.

2. The method of claim 1, further comprising:

adding inflection to at least one word of the plurality of words in accordance with the punctuation of the sentence.

3. The method of claim 1, wherein the step of dividing the compared word into a plurality of diphones comprises comparing combinations of letters in the compared word to a database of diphones.

4. The method of claim 1, further comprising:

comparing at least a second word of the plurality of words to a list of homographs;

in the event that the second word of the plurality of words is on the list of homographs, determining parts of speech for words adjacent the second word, selecting a sound file for the second word based on the parts of speech of the adjacent words, and playing the selected sound file.

5. A method for producing a speech rendition of text comprising:

providing a letter to phoneme rules database containing phonetic representations of a predetermined group of words, each letter of each word in the predetermined group of words being represented by a corresponding phoneme, the phoneme for a particular letter being determined based on letters that precede and succeed the particular letter, at least one word of the predetermined group of words including two or more letters that collectively have a single phonetic representation, wherein a first letter of the two or more letters is represented by a phoneme that corresponds to the single phonetic representation and wherein remaining letters of the two or more letters are represented by blank phonemes;

parsing a sentence into punctuation and a plurality of words;

dividing each word of the plurality of words into a plurality of diphones based on combinations of letters in the letter to phoneme rules database;

combining sound files corresponding to the plurality of diphones; and playing the combined sound files.

6. The method of claim 5, further comprising:

adding inflection to at least one word of the plurality of words in accordance with the punctuation of the sentence.

7. The method of claim 5, wherein the step of dividing each word of the plurality of words into a plurality of diphones comprises comparing combinations of letters in each word of the plurality of words to the combinations of letters in the letter to phoneme rules database.

8. A method for producing a speech rendition of text comprising:

providing a letter to phoneme rules database containing phonetic representations of a predetermined group of words, each letter of each word in the predetermined group of words being represented by a corresponding phoneme, the phoneme for a particular letter being determined based on letters that precede and succeed the particular letter, at least one word of the predetermined group of words including two or more letters that collectively have a single phonetic representation, wherein a first letter of the two or more letters is represented by a phoneme that corresponds to the single phonetic representation and wherein remaining letters of the two or more letters are represented by blank phonemes;

parsing a sentence into punctuation and a plurality of words;

comparing at least one word of the plurality of words to a list of pre-recorded words;

in the event that the compared word is not on the list of pre-recorded words, dividing the compared word into a plurality of diphones based on combinations of letters in the letter to phoneme rule database, combining sound files corresponding to the plurality of diphones, and playing the combined sound files;

in the event that the compared word is on the list of pre-recorded words, playing a sound file corresponding to the compared word, the sound file being independent of the sound files corresponding to the plurality of diphones.

9. A method for producing a speech rendition of text comprising:

providing a letter to phoneme rules database containing phonetic representations of a predetermined group of words, each letter of each word in the predetermined group of words being represented by a corresponding phoneme, the phoneme for a particular letter being determined based on three letters that precede and three letters that succeed the particular letter;

parsing a sentence into punctuation and a plurality of words;

comparing at least one word of the plurality of words to a list of pre-recorded words, in the event that the compared word is not on the list of pre-recorded words, dividing the compared word into a plurality of diphones based on combinations of letters in the letter phoneme rules database, combining sound files corresponding to the plurality of diphones, and playing the combined sound files;

in the event that the compared word is on the list of pre-recorded words, playing a sound file corresponding to the compared word, the sound file being independent of the sound files corresponding to the plurality of diphones.

10. A method for producing a speech rendition of text comprising:

providing a letter to pronounce rules database containing phonetic representations of a predetermined group of words, each letter of each word in the predetermined group of words being represented by a corresponding phoneme, the phoneme for a particular letter being determined based on one letter that precedes and two letters that succeed the particular letter;

parsing a sentence into punctuation and a plurality of words;

comparing at least one word of the plurality of words to a list of pre-recorded words;

in the event that the compared word is not on the list of pre-recorded words, dividing the compared word into a plurality of diphones based on combinations of letters in the letter to phoneme rules database, combining sound files corresponding to the plurality of diphones, and playing the combined sound files;

in the event that the compared word is on the list of pre-recorded words, playing a sound file corresponding to the compared word, the sound file being independent of the sound files corresponding to the plurality of diphones.

11. A method for producing a speech rendition of text comprising:

providing a letter to phoneme rules database containing phonetic representations of a predetermined group of words, each letter of each word in the predetermined group of words being represented by a corresponding phoneme, the phoneme for a particular letter being determined based on three letters that precede and three letters that succeed the particular letter;

parsing a sentence into punctuation and a plurality of words;

dividing each word of the plurality of words into a plurality of diphones based on combinations of letters in the letter to phoneme rules database;

combining sound files corresponding to the plurality of diphones; and playing the combined sound files.

12. A method for producing a speech rendition of text comprising:

providing a letter to phoneme rules database containing phonetic representations of a predetermined group of words, each letter of each word in the predetermined group of words being represented by a corresponding phoneme, the phoneme for a particular letter being determined based on one letter that precedes and two letters that succeed the particular letter;

parsing a sentence into punctuation and a plurality of words;

dividing each word of the plurality of words into a plurality of diphones based on combinations of letters in the letter to phoneme rules database;

combining sound files corresponding to the plurality of diphones; and playing the combined sound files.

13. A method for producing a speech rendition of text comprising:

parsing a sentence into a plurality of words;

comparing a first word of the plurality of words to a list of homographs;

in the event that the first word is on the list of homographs, determining parts of speech for words adjacent the first word;

selecting a sound file for the first word based on the parts of speech of the adjacent words, the sound file being independent of sound files corresponding to diphones associated with the first word, and playing the selected sound file;

in the event that the first word is not on the list of homographs, comparing the first word to a list of pre-recorded words;

in the event that the first word is not on the list of homographs, comparing the first word to a list of pre-recorded words;

in the event that the first word is not on the list of homographs and is not on the list of pre-recorded words, dividing the first word into a plurality of diphones, combining sound files corresponding to the plurality of diphones, and playing the combined sound files;

in the event that the first word is not on the list of homographs and is on the list of pre-recorded words, playing a sound file corresponding to the first word, the sound file being independent of the sound files corresponding to the plurality of diphones.

14. The method of claim 13, further comprising:

in the event that the first word is not on the list of pre-recorded words and prior to dividing the first word into a plurality of diphones, determining whether the first word includes at least one number, and in the event that the first word includes at least one number, audibly spelling the first word out instead of dividing the first word into a plurality of diphones, combining sound files, and playing the combined sound files.

15. The method of claim 13, further comprising:

providing a letter to phoneme rules database containing phonetic representations of a predetermined group of words, each letter of each word in the predetermined group of words being represented by a corresponding phoneme, the phoneme for a particular letter being determined based on letters that precede and succeed the particular letter;

wherein the step of dividing the first word into a plurality of diphones comprises dividing the first word into a plurality of diphones based on combinations of letters in the letter to phoneme rules database.

16. The method of claim 15, wherein at least one word of the predetermined group of words includes two or more letters that collectively have a single phonetic representation, wherein a first letter of the two or more letters is represented by a phoneme that corresponds to the single phonetic representation, and wherein remaining letters of the two or more letters are represented by blank phonemes.

17. The method of claim 15, wherein the corresponding phoneme for a particular letter is determined based on three letters that preceded and three letters that succeed the particular letter.

* * * * *